US010852097B2

(12) United States Patent
Wilson et al.

(10) Patent No.: US 10,852,097 B2
(45) Date of Patent: Dec. 1, 2020

(54) ARROW REST CORD LENGTH AND LOCK ADJUSTMENT DEVICE

(71) Applicant: HAMSKEA ARCHERY SOLUTIONS LLC, Frederick, CO (US)

(72) Inventors: Scott Wilson, Brighton, CO (US); Andrew Walther Munsell, Brighton, CO (US)

(73) Assignee: Hamskea Archery Solutions LLC, Frederick, CO (US)

( * ) Notice: Subject to any disclaimer, the term of this patent is extended or adjusted under 35 U.S.C. 154(b) by 0 days.

(21) Appl. No.: 16/549,180

(22) Filed: Aug. 23, 2019

(65) Prior Publication Data

US 2020/0116452 A1 Apr. 16, 2020

Related U.S. Application Data

(60) Provisional application No. 62/745,435, filed on Oct. 14, 2018.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/14; F41B 5/143; F41B 5/1403
USPC ..... 124/44.5, 86, 90
See application file for complete search history.

(56) References Cited

U.S. PATENT DOCUMENTS 2,947,301 A * 8/1960 Haulk ..... F41B 5/14 124/90
3,504,659 A * 4/1970 Babington ..... F41B 5/143 124/24.1
3,802,411 A * 4/1974 Manspeaker ..... F41B 5/1411 124/90
4,005,696 A * 2/1977 Jennings ..... F41B 5/10 124/25.6
4,079,722 A * 3/1978 Griggs ..... F41B 5/10 124/24.1
4,287,868 A * 9/1981 Schiff ..... F41B 5/143 124/24.1
4,372,285 A * 2/1983 Simonds ..... F41B 5/10 124/25.6
4,407,261 A * 10/1983 Elliott ..... F41B 5/143 124/25.6

(Continued)

OTHER PUBLICATIONS

Co-owned U.S. Appl. No. 16,299,988, filed Mar. 12, 2019.

*Primary Examiner* — Alexander R Niconovich
(74) *Attorney, Agent, or Firm* — Trenner Law Firm, LLC; Mark D. Trenner

(57) ABSTRACT

An arrow rest cord length and lock adjustment device is disclosed. An example device includes a body having a plate section between a first end portion and a second end portion. A plurality of openings are formed in the body. A cord is threaded through the openings so that when the cord is under tension and fixed at one end of the body, one of the openings applies an orthogonal torquing force about an axis of another of the openings which in turn imparts a binding effect on the cord. At least one detent is provided on the body. An o-ring is received in the at least one detent and provided over a portion of the cord and a portion of a perimeter of the body to bring the cord closer to the plate section of the body.

16 Claims, 8 Drawing Sheets

(56) References Cited

U.S. PATENT DOCUMENTS 4,476,846 A 10/1984 Carville
4,664,093 A 5/1987 Nunemaker
4,686,956 A 8/1987 Troncoso, Jr.
4,803,971 A * 2/1989 Fletcher ..... F41B 5/143 124/24.1
4,827,895 A 5/1989 Troncoso, Jr.
5,117,803 A 6/1992 Johnson
5,140,972 A * 8/1992 Fisk ..... F41B 5/143 124/24.1
5,365,912 A * 11/1994 Pittman ..... F41B 5/143 124/24.1
5,386,814 A 2/1995 Denton
5,394,858 A * 3/1995 Karolian ..... F41B 5/143 124/44.5
5,429,107 A 7/1995 Troncoso, Jr.
5,606,962 A 3/1997 Troncoso
5,632,263 A * 5/1997 Sartain ..... F41B 5/143 124/44.5
5,678,530 A 10/1997 Van Drielen
5,960,779 A 10/1999 Jessee et al.
6,044,832 A * 4/2000 Piersons, Jr. ..... F41B 5/143 124/44.5
6,089,216 A 7/2000 Harwath et al.
6,363,924 B1 4/2002 Adams, Jr.
6,591,823 B1 7/2003 Keller
6,595,195 B1 7/2003 Barner et al.
6,739,321 B1 * 5/2004 Puchlerz ..... F41B 5/143 124/44.5
6,782,881 B2 * 8/2004 Mizek ..... F41B 5/143 124/44.5
6,913,008 B2 * 7/2005 Simo ..... F41B 5/143 124/44.5
6,915,791 B2 * 7/2005 Harwath ..... F41B 5/143 124/44.5
7,100,591 B2 * 9/2006 Terry ..... F41B 5/143 124/25.6
7,597,095 B2 * 10/2009 Grace, Jr. ..... F41B 5/143 124/44.5
7,681,566 B2 * 3/2010 Mertens ..... F41B 5/143 124/44.5
7,717,103 B2 * 5/2010 Johnson ..... F41B 5/143 124/44.5
7,748,371 B1 * 7/2010 Doty ..... F41B 5/143 124/44.5
7,913,678 B2 * 3/2011 Hudkins ..... F41B 5/143 124/44.5
8,333,180 B2 * 12/2012 Mizek ..... F41B 5/143 124/44.5
8,342,161 B2 1/2013 Harwath et al.
8,474,443 B2 * 7/2013 Geno ..... F41B 5/143 124/44.5
8,752,536 B2 * 6/2014 Sims ..... F41B 5/10 124/44.5
8,826,896 B1 * 9/2014 McPherson ..... F41B 5/1411 124/90
8,875,687 B1 11/2014 Huang et al.
8,960,174 B2 * 2/2015 Khoshnood ..... F41B 5/143 124/44.5
9,151,567 B1 * 10/2015 Estridge ..... F41B 5/143
9,182,190 B2 * 11/2015 Khoshnood ..... F41B 5/143
9,341,433 B1 * 5/2016 Summers ..... F41B 5/143
9,933,229 B2 * 4/2018 Coalson ..... F41B 5/143
2006/0157038 A1 * 7/2006 Ellig ..... F41B 5/143 124/44.5
2015/0184972 A1 * 7/2015 Grace ..... F41B 5/143 124/44.5

* cited by examiner

PRIOR ART

PRIOR ART

ARROW REST CORD LENGTH AND LOCK ADJUSTMENT DEVICE

CROSS REFERENCE TO RELATED APPLICATIONS

This application claims the priority benefit of U.S. Provisional Patent Application No. 62/745,435 filed Oct. 14, 2018 for "Arrow Rest Cord Length And Lock Adjustment Device," hereby incorporated by reference in its entirety as though fully set forth herein.

BACKGROUND

Existing devices for cord length adjustment make use of a two-piece mechanical clamp/compression approach that captures the cord in two places. In order to adjust the length with these devices, the compression force is reduced or eliminated by loosening the compression screw. This allows the user to increase or decrease the length of the cord tab, which results in changing the cord length as it is looped around an accommodating feature of the arrow rest.

There are two major categories of mechanized arrow rests that make use of a cord to activate the rest: 1) fall-away, and 2) limb actuated. In the fall-away (e.g., rotating arrow rest, a rod rotating the attached launcher down and away from the arrow shaft via internal torsional spring) uses a cord that is attached to the bow system (usually the cable). When the bow is drawn back to launch the arrow, the cord imparts a force that overcomes the internal torsion spring force to lift the launcher into position to support the arrow for launch. It is necessary to adjust or tune the length of the cord for each bow and arrow rest combination.

In the limb actuated arrow rest, linear force supplied by intra-bow mechanics or cord attached to the limb applies to the rotating arrow rest rod and rotates the attached launcher down and away from the arrow shaft. The limb actuated style arrow rests uses a cord to transfer the linear intra-bow force to a lever arm that is connected to the rotating shaft of the arrow rest. It is necessary to adjust or tune the length of the cord for each bow and arrow rest combination.

For either type of arrow rest, over many shots, the cord material tends to stretch until it is settled. This requires having to adjust the cord length to optimize system performance.

DETAILED DESCRIPTION

An arrow rest cord length and lock adjustment device is disclosed. In an example, the device enables fast, repeatable and secure cord length adjustments for all mechanized arrow rests that make use of a cord.

In an example, the arrow rest cord adjustment device is provided integral to a mechanized arrow rest system that makes use of a cord that is attached to an element of a bow (e.g., a limb, cable, etc.) to aid in the operation of the mechanized arrow rest. Specifically, it is a one-piece mechanical device that operates on tension in the cord generated by mounting geometries in a bow system. The cord tension, when applied according to geometric features of the device, generates mechanical leverage against the cord to secure the device in place, integral to the cord itself, allowing for the cord length to be adjusted and optimized for operation of the arrow rest when installed in an archery bow system. The result is the ability to change the length of the cord when one end of the cord is secured to the device.

In an example, the device when used in conjunction with the cord, allows for quick, repeatable and secure cord length adjusts which are critical in the performance of a mechanized arrow rest system.

In an example, the device provides a simple design that allows the archer to quickly make adjustments to the length of the arrow rest cord that does not slip.

Before continuing, it is noted that as used herein, the terms "includes" and "including" mean, but is not limited to, "includes" or "including" and "includes at least" or "including at least" The term "based on" means "based on" and "based at least in part on."

Figure 1A:
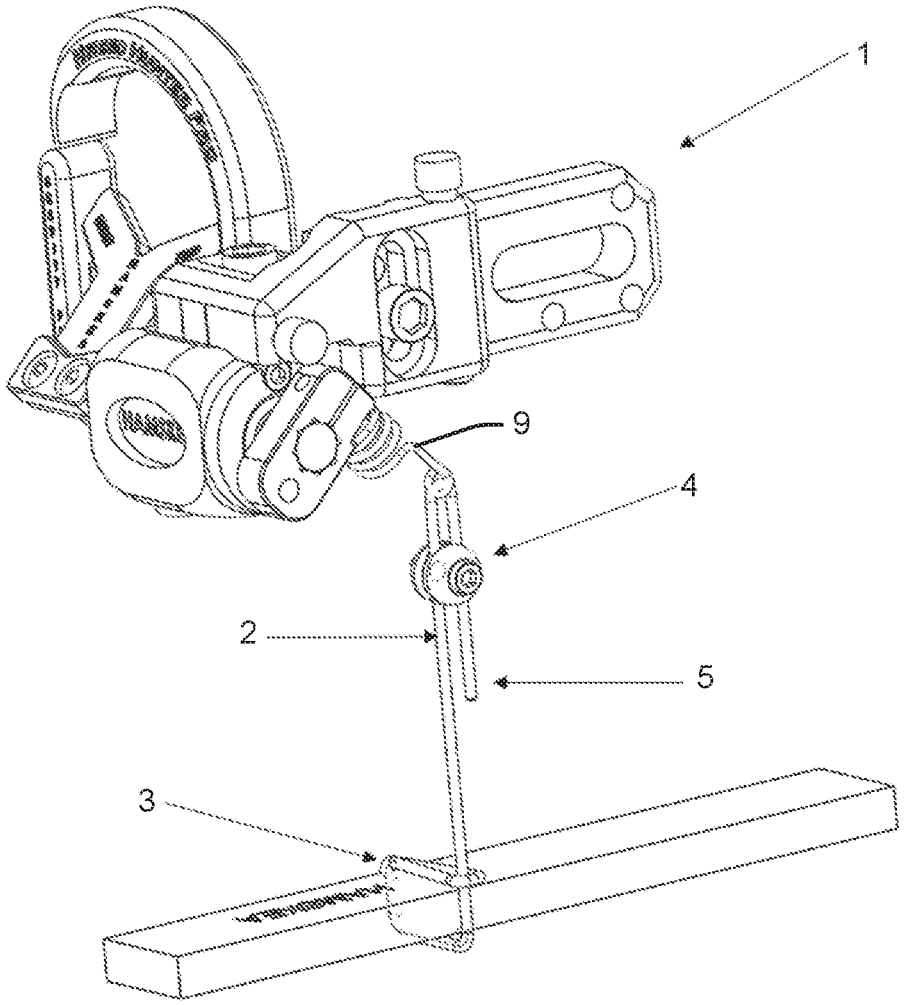
FIG. 1A is a perspective view of a conventional cord clamp device as it may be provided for a mechanized limb actuated arrow rest.

The device can be provided as an integral part of an arrow rest system installed in an archery bow system for target, hunting, and/or recreational use. The device can be implemented with any mechanized arrow rest (e.g., fall away, limb actuated) where the length of the cord can be adjusted in length during the installation process and optimized during the tuning/shooting process. FIG. 1A is a perspective view of a mechanized limb actuated arrow rest 1 with which the device disclosed herein may be implemented. The arrow rest 1 includes a looped cord 2 for length adjustment. The cord 2 is attached to the limb 3 of the bow system. The conventional cord clamp device 4 is shown holding the cord 2 as the loose/tab end 5 of the cord 2 may hang free.

Figure 1B:
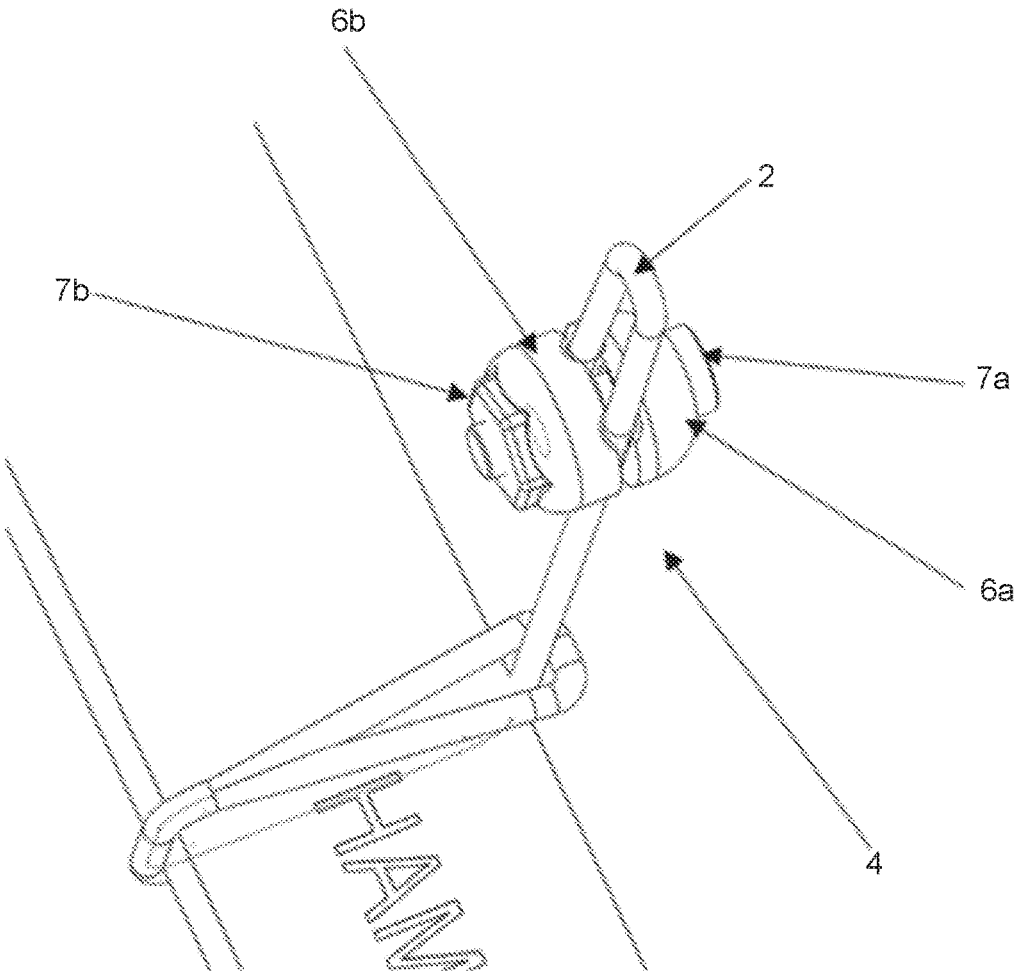
FIG. 1B is a close up perspective view of the cord clamp device shown in FIG. 1A.

FIG. 1B is a close up perspective view of the cord clamp device 4 shown in FIG. 1A. The cord clamp device 4 includes a cord clamp having a first side 6*a* and a second side 6*b*, held together by a screw 7*a* and nut 7*b*. The cord 2 is looped through the cord clamp device 4 and secured by tightening the screw 7*a* and nut 7*b*.

The arrow rest cord length and lock adjustment device 10 disclosed herein replaces the conventional multi-part assembly 4 that applies an inline compression force to secure the cord length and from which the cord length adjustments can be made. It is noted that the device 10 may be implemented with any arrow rest, including but not limited to a fall away arrow rest, bottom limb actuation arrow rest, and top limb actuation arrow rest.

Figure 2:
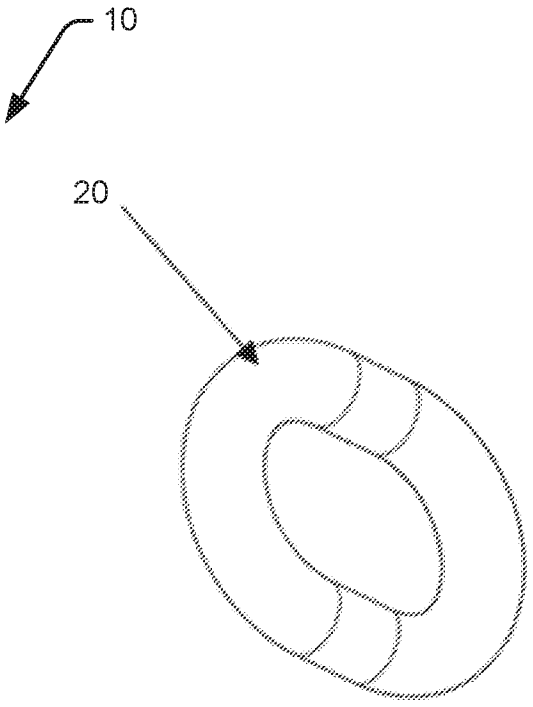
FIG. 2 shows perspective views of an example cord length and lock adjustment device.
Figure 2:
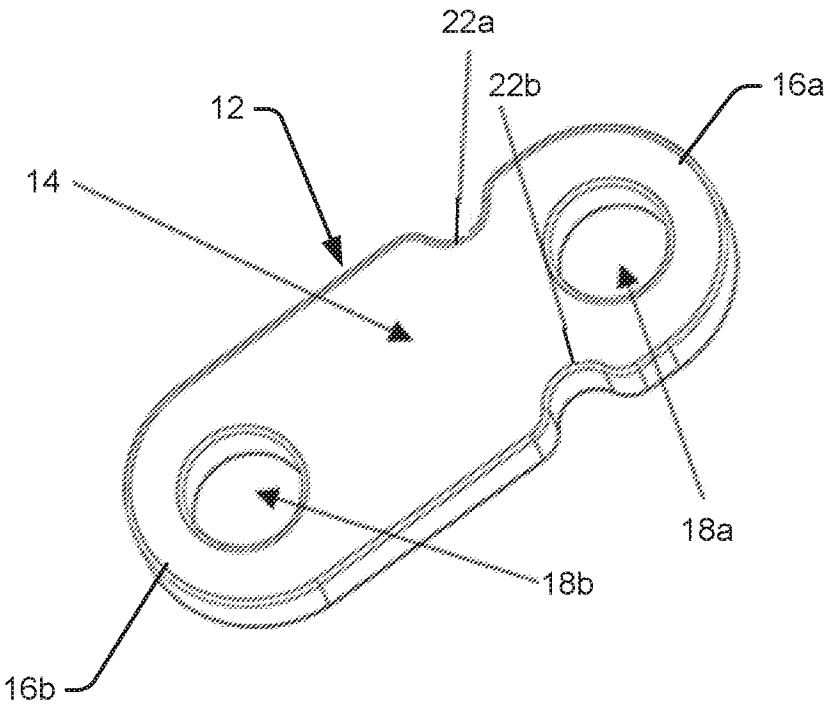

FIG. 2 shows perspective views of an example cord length and lock adjustment device 10. In an example, the arrow rest cord length and lock adjustment device 10 includes a body 12 having a plate section 14 between a first end portion 16*a* and a second end portion 16*b*. The example device 10 also includes a first opening 18*a* formed in the first end portion 16*a* of the body 12. A second opening 18*b* is formed in the second end portion 16*b* of the body 12. The cord 2 is threaded through the openings 16*a*, 16*b* so that when the cord 2 is under tension and fixed at one end of the body 12 (e.g., by knot 8), the first opening 16*a* applies an orthogonal torquing force about an axis of the second opening 16*b* which in turn imparts a binding effect on the cord 2.

The body 12 may be manufactured from any of a variety of materials. Example materials include but are not limited to metal, composites and materials suitable for mold injection applications.

In an example, the device 10 also includes a force multiplier such as compression ring 20 (e.g., an o-ring) provided over a portion of the cord 2 and a portion of a perimeter of the body 12 to bring the cord 2 closer to the plate section 14 of the body 12, resulting in imparting additional force that increases a binding force on the cord 2 applied by the plate section 14 of the body 12.

In an example, the device 10 also includes at least one detent 22*a*, 22*b* on the body 12. The o-ring 20 is received in the detent(s) 22*a*, 22*b*. The binding force is increased by the o-ring 20, holding the cord 2 in place for maximum binding force as applied to the cord 2. When the o-ring 20 is released, the o-ring force is released and positioning the body 12 orthogonal to a linear force vector of the cord enables relocating of the body on the cord for cord length adjustment.

In an example, the device 10 also includes a locating feature (e.g., detents) for the o-ring to apply an additional binding force to the cord as applied through a mechanical lever action between the o-ring and binding force of the plate.

Mechanized arrow rests of either the fall-away or actuated types use a cord (a tethering device) to actuate a mechanized rest. It is necessary to be able to adjust the cord length quickly and repeatedly without it slipping, which compression type cord locks are prone to do. The device 10 enables an efficient, repeatable, and reliable method for adjusting the length of the cord 2 on a mechanized arrow rest (e.g., arrow rest 1 in FIG. 1A).

Figure 3:
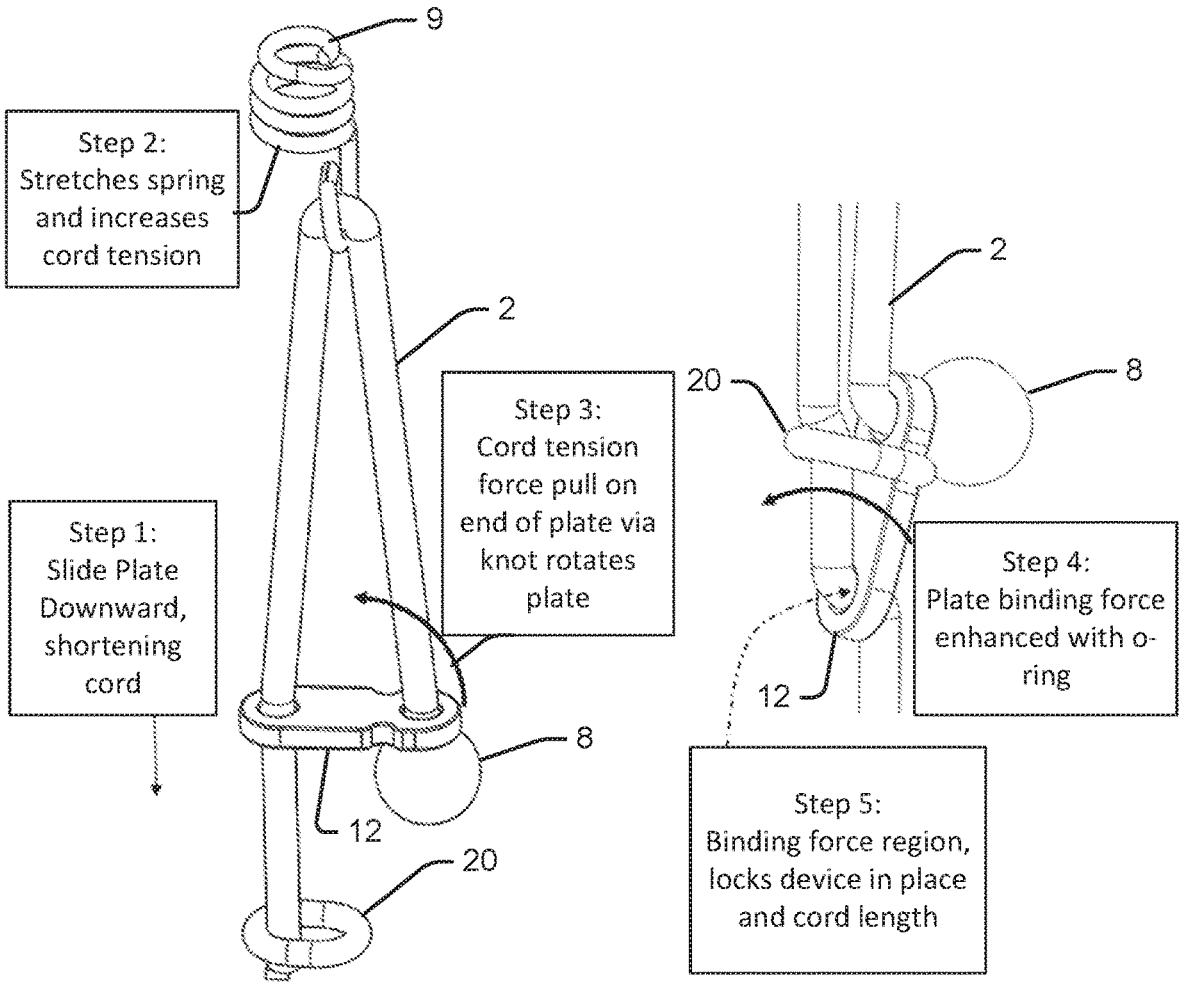
FIG. 3 is a perspective view of an example cord lock adjustment device illustrating example operation.
Figure 4:
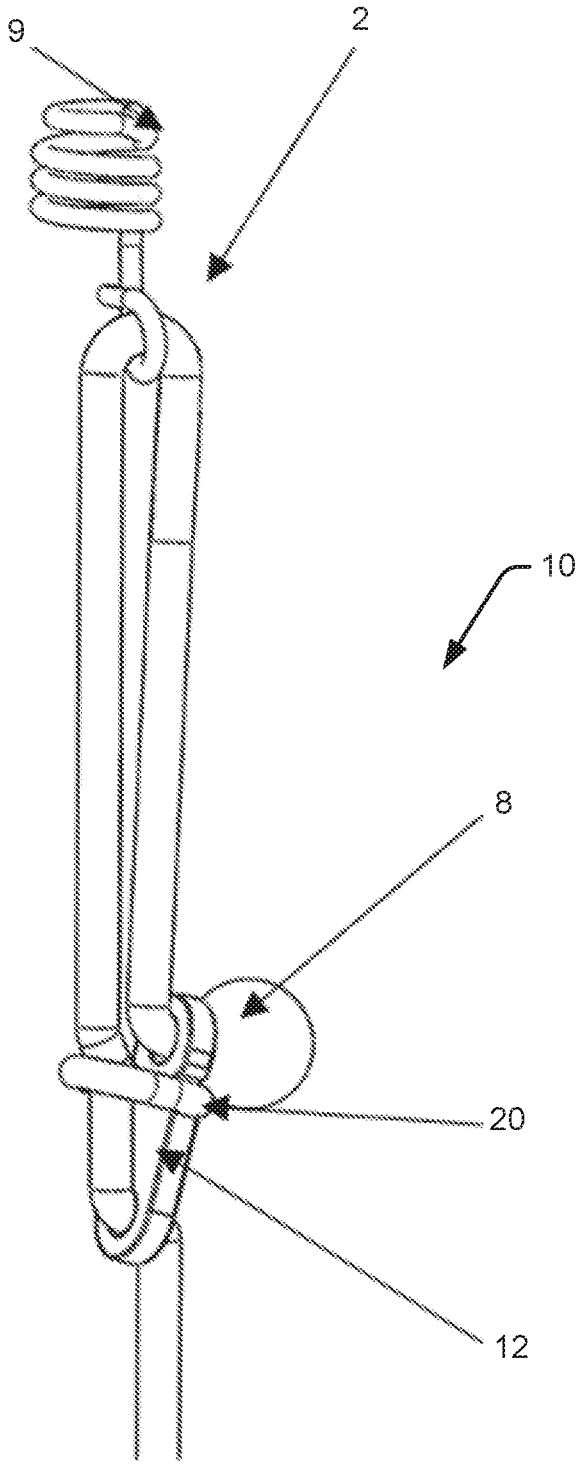
FIG. 4 is a perspective view of an example cord lock in situ for actuated arrow rest configuration.

FIG. 3 is a perspective view of an example cord lock adjustment device 10 illustrating example operation (e.g., Steps 1-5). FIG. 4 is a perspective view of an example cord lock in situ for actuated arrow rest configuration. During an example operation, the body 12 slides downward to shorten the cord 2. This stretches the spring 9 and increases cord tension. The cord tension force pulls on the end of the body 12 via a hard top on the card (e.g., the knot 8) and rotates the body 12. The plate binding force is enhanced by implementing the o-ring 20. The binding force region locks the device in place for the selected cord length.

When a cord 2 is threaded through the through holes or openings 18*a*, 18*b* in such a fashion that the cord 2, when under tension and fixed at one end of the body 12 (e.g., by a knot 8), an orthogonal torquing force is applied about the axis of the opposite through hole, which in turn imparts a binding effect (i.e., cord is non-linear) on the cord 2.

This binding force is enhanced by the o-ring 20 which is received by complementary detent features 22*a*, 22*b* in the perimeter of the plate section 14 or elsewhere on the body 12. The o-ring 20 holds it in place for maximum binding force as applied to the cord 2. By releasing the o-ring force and positioning the body 12 orthogonal to the linear force vector of the cord 2, the device 10 can be relocated up or down on the cord 2 for optimum cord length adjustment(s).

The operations shown and described herein are provided to illustrate example implementations. It is noted that the operations are not limited to the ordering shown. Still other operations may also be implemented.

Before continuing, it should be noted that the examples described above are provided for purposes of illustration, and are not intended to be limiting. Other devices and/or device configurations may be utilized to carry out the operations described herein.

FIGS. 5A-5F are perspective views of other example cord length and lock adjustment devices 10.

Figure 5A:
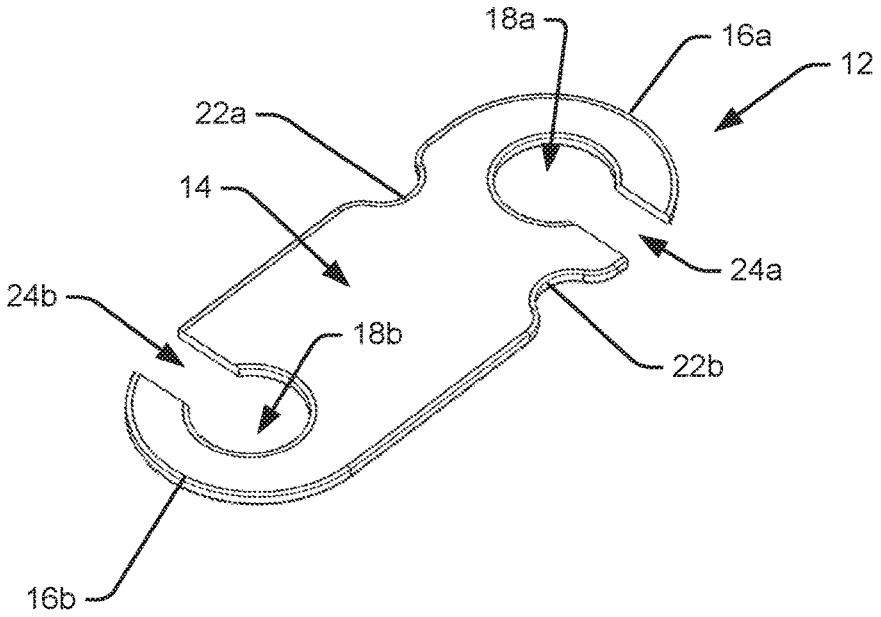
FIGS. 5A-5E are perspective views of other example cord length and lock adjustment devices.
Figure 5B:
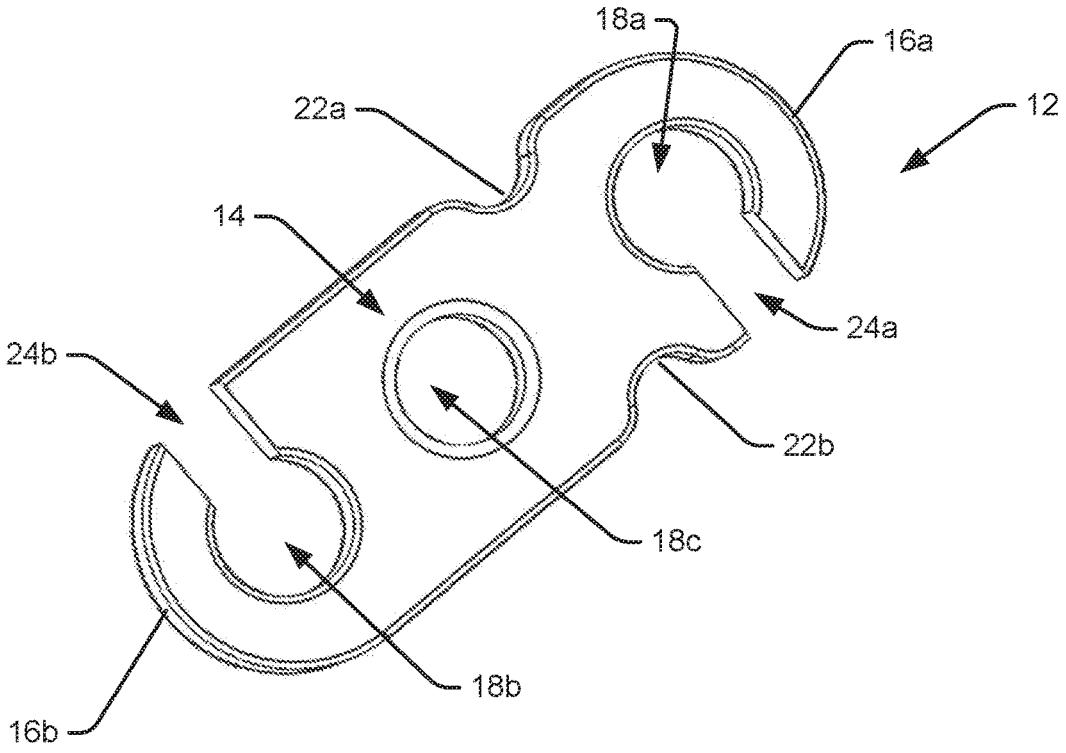
Figure 5C:
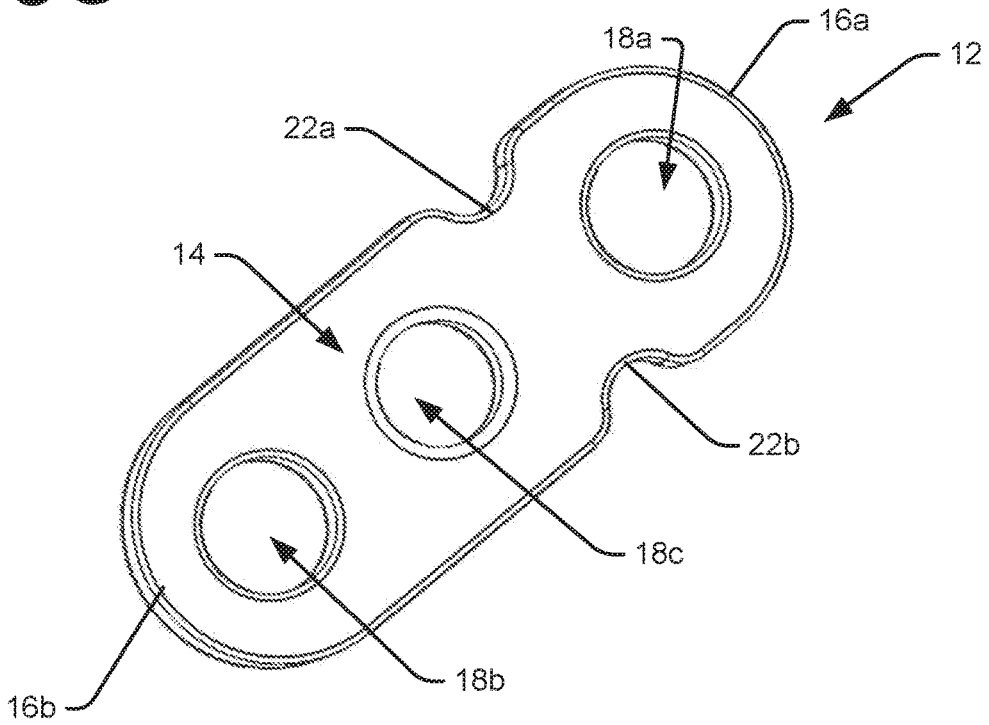
Figure 5D:
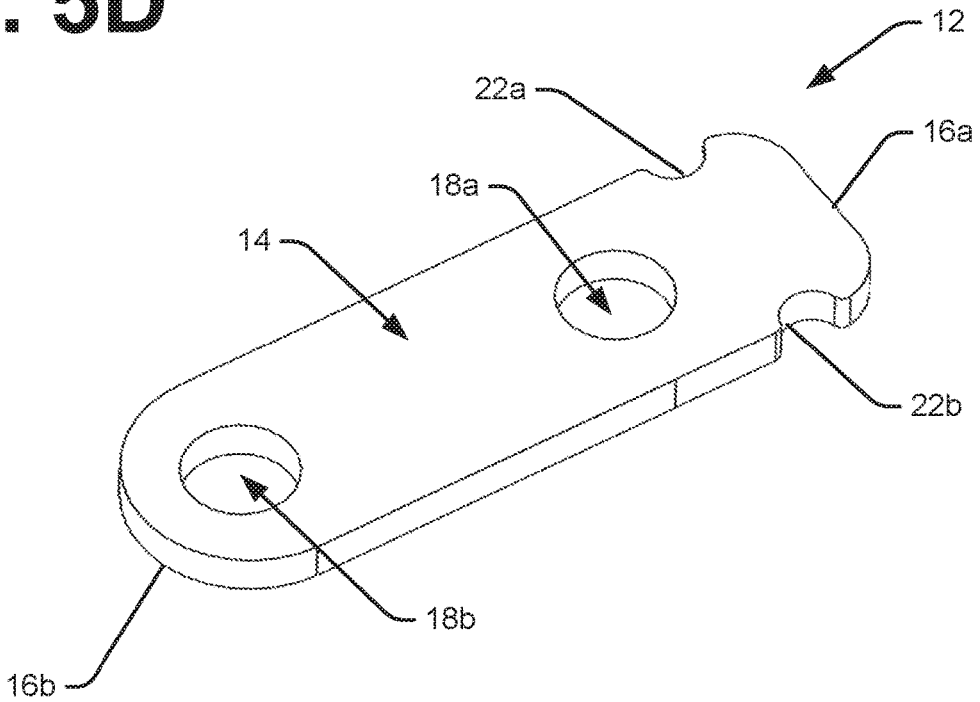
Figure 5E:
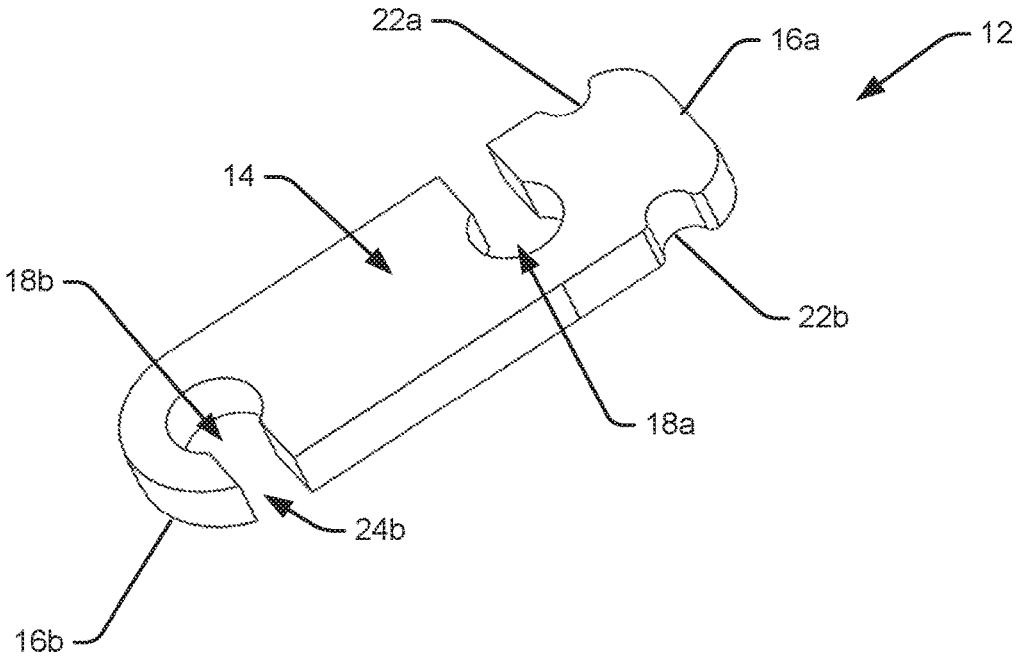

In an example, the device 10 also includes at least one slotted feature of the body 12, as shown in FIGS. 5A, 5B, and 5E. For example, slotted features 24*a* and 24*b* are shown in FIG. 5A. The slotted feature may be formed in the plate section 14 of the body 12. In an example, the slotted feature is formed at the first end and/or second end of the body 12. One, two, or more slotted features may be included.

In an example, the device 10 also includes at least a third opening 18*c* in the body 12, as shown in FIGS. 5B and 5C.

In an example, the opening(s) may be at any suitable location on the body 12. For example, in FIGS. 5D and 5E the opening 18*b* is shown further away from the edge than the opening 18*a* (e.g., the detents 22*a* and 22*b* are closer to the one end).

It is noted that the examples shown and described are provided for purposes of illustration and are not intended to be limiting. Still other examples are also contemplated.

The invention claimed is:

1. An arrow rest cord length and lock adjustment device, comprising:

a body having a plate section between a first end portion and a second end portion;

a first opening formed in the first end portion of the body;

a second opening formed in the second end portion of the body, wherein a cord is threaded through the first opening and the second opening so that when the cord is under tension and fixed at one end of the body, the first opening applies an orthogonal torquing force about an axis of the second opening which in turn imparts a binding effect on the cord;

a force multiplier provided over a portion of the cord and a portion of a perimeter of the body to bring the cord closer to the plate section of the body to impart additional force and increase a binding force on the cord applied by the plate section of the body; and at least one detent on the body, the force multiplier received in the at least one detent, wherein the binding force is increased by the force multiplier holding the cord in place for maximum binding force as applied to the cord so that when the force multiplier is released the body is positioned orthogonal to a linear force vector of the cord to relocate the body on the cord for cord length adjustment.

2. The device of claim 1, wherein the force multiplier is an o-ring, and releasing the o-ring force and positioning the body orthogonal to a linear force vector of the cord enables relocating of the body on the cord for cord length adjustment.

3. The device of claim 2, further comprising a locating feature for the force multiplier to apply an additional binding force to the cord as applied through a mechanical lever action between the o-ring and binding force of the plate.

4. The device of claim 1, further comprising at least one slotted feature of the body.

5. The device of claim 4, wherein the at least one slotted feature is formed in the plate section of the body.

6. The device of claim 4, wherein the at least one slotted feature is formed at the first end of the body.

7. The device of claim 1, further comprising at least a third opening in the body.

8. An arrow rest cord length and lock adjustment device, comprising:

a body having a plate section between a first end portion and a second end portion;

a plurality of openings formed in the body, wherein a cord is threaded through the openings so that when the cord is under tension and fixed at one end of the body, one of the openings applies an orthogonal torquing force about an axis of another of the openings which in turn imparts a binding effect on the cord;

a force multiplier provided over a portion of the cord and a portion of a perimeter of the body to bring the cord closer to the plate section of the body to impart additional force and increase a binding force on the cord applied by the plate section of the body; and at least one detent on the body the force multiplier received in the at least one detent, wherein the binding force is increased by the force multiplier holding the cord in place for maximum binding force as applied to the cord so that when the force multiplier is released the body is positioned orthogonal to a linear force vector of the cord to relocate the body on the cord for cord length adjustment.

9. The device of claim 8, wherein the force multiplier is an o-ring provided over a portion of the cord and a portion of a perimeter of the body to bring the cord closer to the plate section of the body, resulting in imparting additional force that increases a binding force on the cord applied by the plate section of the body.

10. The device of claim 9, wherein the binding force is increased by the o-ring, holding the cord in place for maximum binding force as applied to the cord.

11. The device of claim 10, wherein releasing the o-ring force and positioning the body orthogonal to a linear force vector of the cord enables relocating of the body on the cord for cord length adjustment.

12. The device of claim 9, further comprising a locating feature for the o-ring to apply an additional binding force to the cord as applied through a mechanical lever action between the o-ring and binding force of the plate.

13. The device of claim 8, further comprising at least one slotted feature of the body.

14. The device of claim 8, further comprising at least a third opening in the body.

15. An arrow rest cord length and lock adjustment device, comprising:

a body having a plate section between a first end portion and a second end portion;

a plurality of openings formed in the body, wherein a cord is threaded through the openings so that when the cord is under tension and fixed at one end of the body, one of the openings applies an orthogonal torquing force about an axis of another of the openings which in turn imparts a binding effect on the cord;

a force multiplier provided over a portion of the cord and a portion of a perimeter of the body to bring the cord closer to the plate section of the body to impart additional force and increase a binding force on the cord applied by the plate section of the body; and at least one detent on the body, the force multiplier received in the at least one detent, wherein the binding force is increased by the force multiplier holding the cord in place for maximum binding force as applied to the cord so that when the force multiplier is released the body is positioned orthogonal to a linear force vector of the cord to relocate the body on the cord for cord length adjustment.

16. The device of claim 15, further comprising at least one slotted feature of the body.

* * * * *